US012311247B2

(12) United States Patent
Akeel et al.

(10) Patent No.: US 12,311,247 B2
(45) Date of Patent: May 27, 2025

(54) EXERCISE SYSTEM WITH A VARIABLE RESISTANCE UNIT AND AN IMPROVED PERFORMANCE SOFTWARE APPLICATION

(71) Applicant: MAXPRO Fitness LLC, Rochester, MI (US)

(72) Inventors: Nezar Akeel, Rochester, MI (US); Harold Wilson, Holland, MI (US); Armando Cali, Macomb, MI (US)

(73) Assignee: MAXPRO Fitness LLC, Rochester, MI (US)

( * ) Notice: Subject to any disclaimer, the term of this patent is extended or adjusted under 35 U.S.C. 154(b) by 126 days.

(21) Appl. No.: 17/935,536

(22) Filed: Sep. 26, 2022

(65) Prior Publication Data

US 2023/0264094 A1 Aug. 24, 2023

Related U.S. Application Data

(60) Provisional application No. 63/248,246, filed on Sep. 24, 2021.

(51) Int. Cl.

| | |
|---|---|
| ***A63B 71/06*** | (2006.01) |
| ***A63B 21/00*** | (2006.01) |
| ***A63B 23/035*** | (2006.01) |
| ***A63B 24/00*** | (2006.01) |

(52) U.S. Cl.

CPC ..... *A63B 71/0622* (2013.01); *A63B 21/153* (2013.01); *A63B 21/4029* (2015.10); *A63B 21/4035* (2015.10); *A63B 23/03541* (2013.01); *A63B 24/0062* (2013.01);

(Continued)

(58) Field of Classification Search

CPC ..... A63B 21/153; A63B 21/4029; A63B 21/4035; A63B 21/4042; A63B 23/03541; A63B 24/0062; A63B 71/0622; A63B 2024/0065; A63B 2071/065; A63B 2220/30; A63B 2220/833; A63B 2225/20; A63B 2225/50; A63B 2230/06; A63B 2230/202; A63B 2230/30; A63B 2230/50

See application file for complete search history.

(56) References Cited

U.S. PATENT DOCUMENTS

| | | | | |
|---|---|---|---|---|
| 11,179,601 | B2 * | 11/2021 | Wiebe | G09B 19/003 |
| 2013/0303334 | A1 * | 11/2013 | Adhami | A63B 24/0087 482/4 |

(Continued)

*Primary Examiner* — Megan Anderson

(74) *Attorney, Agent, or Firm* — Mark L. Maki; Miller Canfield

(57) ABSTRACT

An exercise system includes a resistance unit for the performance of a wide variety of exercises including those previously performed using free weights, exercise machines, rowing machines, and/or ski machines. The resistance unit is usable alone or with a bench system that preferably includes a bench unit. The bench system can include an extension unit mounted to the bench unit, wherein a resistance unit is mountable to the exercise system in a plurality of mounting positions that align with various bench configurations to permit the performance of a wide variety of resistance exercises. The exercise system includes a software application which receives and analyzes data received from the resistance unit and generates a graphical user interface on a display unit for optimized display and representation of real time training data and an interpretation of the results.

20 Claims, 13 Drawing Sheets

(52) U.S. Cl.
CPC . *A63B 2024/0065* (2013.01); *A63B 2071/065* (2013.01); *A63B 2230/06* (2013.01)

(56) References Cited

U.S. PATENT DOCUMENTS

2019/0046107 A1* 2/2019 Jang ..... A61B 5/4519
2019/0118022 A1* 4/2019 Carter ..... A63B 21/16

* cited by examiner

| Velocity Decrement | Color | Zone | FiberType | | reps | | Duration | Energy System |
|---|---|---|---|---|---|---|---|---|
| 0% | Green | Power | Type IIX | | | | 0 | ATP |
| 1% | Green | Power | Type IIX | | | | 1 | ATP |
| 2% | Green | Power | Type IIX | | | | 2 | ATP |
| 3% | Green | Power | Type IIX | | | | 3 | ATP |
| 4% | Green | Power | Type IIX | | | | 4 | ATP |
| 5% | Green | Power | Type IIX | | | | 5 | ATP |
| 6% | Green | Power | Type IIX | | | | 6 | ATP |
| 7% | Green | Power | Type IIX | | | | 7 | ATP |
| 8% | Green | Power | Type IIX | | | | 8 | ATP |
| 9% | Green | Power | Type IIX | | | | 9 | ATP |
| 10% | Yellow | Strength | Type IIX + Type IIA | | | | 10 | ATP |
| 11% | Yellow | Strength | Type IIX + Type IIA | | | | 10 | Glycolytic |
| 12% | Yellow | Strength | Type IIX + Type IIA | | | | 11 | Glycolytic |
| 13% | Yellow | Strength | Type IIX + Type IIA | | | | 12 | Glycolytic |
| 14% | Yellow | Strength | Type IIX + Type IIA | | | | 13 | Glycolytic |
| 15% | Yellow | Strength | Type IIX + Type IIA | | | | 14 | Glycolytic |
| 16% | Yellow | Strength | Type IIX + Type IIA | | | | 15 | Glycolytic |
| 17% | Yellow | Strength | Type IIX + Type IIA | | | | 16 | Glycolytic |
| 18% | Yellow | Strength | Type IIX + Type IIA | | | | 17 | Glycolytic |
| 19% | Yellow | Strength | Type IIX + Type IIA | | | | 18 | Glycolytic |
| 20% | Orange | Strength + Hypertrophy | Type IIA | | | | 19 | Glycolytic |
| 21% | Orange | Strength + Hypertrophy | Type IIA | | | | 20 | Glycolytic |
| 22% | Orange | Strength + Hypertrophy | Type IIA | | | | 21 | Glycolytic |
| 23% | Orange | Strength + Hypertrophy | Type IIA | | | | 22 | Glycolytic |
| 24% | Orange | Strength + Hypertrophy | Type IIA | | | | 23 | Glycolytic |
| 25% | Orange | Strength + Hypertrophy | Type IIA | | | | 24 | Glycolytic |
| 26% | Orange | Strength + Hypertrophy | Type IIA | | | | 25 | Glycolytic |
| 27% | Orange | Strength + Hypertrophy | Type IIA | | | | 26 | Glycolytic |
| 28% | Orange | Strength + Hypertrophy | Type IIA | | | | 27 | Glycolytic |
| 29% | Orange | Strength + Hypertrophy | Type IIA | | | | 28 | Glycolytic |
| 30% | Orange | Strength + Hypertrophy | Type IIA | | | | 29 | Glycolytic |
| 31% | Red | Hypertrophy | Type IIA | | | | 30 | Glycolytic |
| 32% | Red | Hypertrophy | Type IIA | | | | 31 | Glycolytic |
| 33% | Red | Hypertrophy | Type IIA | | | | 32 | Glycolytic |
| 34% | Red | Hypertrophy | Type IIA | | | | 33 | Glycolytic |
| 35% | Red | Hypertrophy | Type IIA | | | | 34 | Glycolytic |
| 36% | Red | Hypertrophy | Type IIA | | | | 35 | Glycolytic |
| 37% | Red | Hypertrophy | Type IIA | | | | 36 | Glycolytic |
| 38% | Red | Hypertrophy | Type IIA | | | | 37 | Glycolytic |
| 39% | Red | Hypertrophy | Type IIA | | | | 38 | Glycolytic |
| 40% | Red | Hypertrophy | Type IIA | | | | 39 | Glycolytic |
| 41% | Red | Hypertrophy | Type IIA | | | | 40 | Glycolytic |
| 42% | Red | Hypertrophy | Type IIA | | | | 41 | Glycolytic |
| 43% | Red | Hypertrophy | Type IIA | | | | 42 | Glycolytic |
| 44% | Red | Hypertrophy | Type IIA | | | | 43 | Glycolytic |
| 45% | Red | Hypertrophy | Type IIA | | | | 44 | Glycolytic |
| 46% | Red | Hypertrophy | Type IIA | | | | 45 | Glycolytic |
| 47% | Red | Hypertrophy | Type IIA | | | | 46 | Glycolytic |
| 48% | Red | Hypertrophy | Type IIA | | | | 47 | Glycolytic |
| 49% | Red | Hypertrophy | Type IIA | | | | 48 | Glycolytic |
| 50% | Red | Hypertrophy | Type IIA | | | | 49 | Glycolytic |
| | | | | | | | 50 | Glycolytic |

FIG. 13

| Target zone | Intensity % of $HR_{max}$ bpm | Example duration | Training benefit |
|---|---|---|---|
| 5 MAXIMUM | 90-100% 171-190 bpm | Less than 5 minutes | **Benefits:** Increases maximum sprint race speed. **Feels like:** Very exhausting for breathing and muscles. **Recommended for:** Very fit persons with athletic training background. |
| 4 HARD | 80-90% 152-171 bpm | 2-10 minutes | **Benefits:** Increases maximum performance capacity. **Feels like:** Muscular fatigue and heavy breathing. **Recommended for:** Fit users and for short exercises. |
| 3 MODERATE | 70-80% 133-152 bpm | 10-40 minutes | **Benefits:** Improves aerobic fitness. **Feels like:** Light muscular fatigue, easy breathing, moderate sweating. **Recommended for:** Everybody for typical, moderately long exercises. |
| 2 LIGHT | 60-70% 114-133 bpm | 40-80 minutes | **Benefits:** Improves basic endurance and helps recovery. **Feels like:** Comfortable, easy breathing, low muscle load, light sweating. **Recommended for:** Everybody for longer and frequently repeated shorter exercises. |
| 1 VERY LIGHT | 50-60% 104-114 bpm | 20-40 minutes | **Benefits:** Improves overall health and metabolism, helps recovery. **Feels like:** Very easy for breathing and muscles. **Recommended for:** Basic training for novice exercisers, weight management and active recovery. |

$HR_{max}$ = Maximum heart rate (220-age). Example: 30 years old, 220-30 = 190 bpm (beats per minute).

FIG. 16

EXERCISE SYSTEM WITH A VARIABLE RESISTANCE UNIT AND AN IMPROVED PERFORMANCE SOFTWARE APPLICATION

CROSS REFERENCE TO RELATED APPLICATION

This application claims priority from co-pending U.S. Provisional Patent Application No. 63/248,246, filed Sep. 24, 2021, the disclosure of which is incorporated herein by reference in its entirety.

FIELD OF THE INVENTION

The invention relates to an exercise device including a variable resistance unit, and in particular to an exercise system, which includes a software application that receives and analyzes real time performance data received from the resistance unit and generates a graphical user interface on a display unit for optimized display and representation of real time training data in a User Interface (UI) including interpretive performance data providing a real time interpretation of the results and performance.

BACKGROUND OF THE INVENTION

Traditional physical fitness exercise devices are well known in the art, including individual free weights and exercise machines, which incorporate weights, resistance units or mechanical resistance to facilitate strength and endurance training. For example, an exercise machine may include movable weights to generate resistance or may incorporate other resistance units such as elastic bands for exercising targeted muscle groups.

Many of these exercise machines are not particularly portable since they may be relatively large, bulky and/or heavy and typically are not moved except for short movements to reposition a machine within a training area. Many exercise machines are dedicated to one particular exercise, such as a treadmill for running and walking, a rowing machine, an exercise bike, or a ski machine. For free weights, the individual weights themselves are heavy and require a relatively large collection of different size weights in a gym area, which again limits portability or suitability for use in other areas outside of the training area. Further, many manufacturers in the fitness industry would not make all of the disparate equipment and machines used in a gym such that a training area is often outfitted with disparate equipment and accessories that require significant floor space and investment.

To address these shortcomings, the applicant for the present invention has developed a compact high resistance fitness device for improved exercising or individual rehabilitation. The resistance unit is configured with at least one resistance module and may used by itself for a range of exercises, or provided in combination with separate conventional accessories such as a simple bench or even a wall-mount to perform other exercises. One example of such a resistance unit is disclosed in PCT Application Publication No. WO 2020/014667 A1, the disclosure of which is incorporated herein by reference in its entirety. The known resistance module includes a pull cord, and a coil storage spool configured to wrap and unwrap the pull cord from the resistance module. The high strength pull cord terminates at its outer end with a handle, such as a hand/foot receptacle. The pull cord has a length sufficient to allow pull strokes of up to fifty feet or more, and the resistance module generates variable weight resistance in a compact and portable resistance unit.

It is an object of the invention to develop an improved exercise system which incorporates a resistance unit of this type in combination with an inventive software application that receives and analyzes real time performance data received from the resistance unit and generates a graphical user interface on a display unit for optimized display and representation of real time training data and an interpretation of the results.

More particularly, the invention relates to a compact high resistance fitness device for superior independent exercising or individual rehabilitation, where at least one resistance unit is provided in combination with an inventive bench construction or system. The resistance unit includes at least one and preferable two resistance modules that each include a coil storage spool configured to wrap and unwrap a pull cord emanating from the resistance module. The high strength pull cord terminates at its outer end with a connector that may connect to a handle, such as a hand/foot receptacle, or other exercise implements, wherein the pull cord has a length sufficient to allow pull strokes with a length suitable for use with the inventive exercise system. Further, the resistance module generates as much weight resistance as a user could want in a compact and portable unit, and the resistance unit can be used separate from the bench system that it is capable of being taken anywhere for use. Of special interest is that the fitness device may include sensors and other means for collecting data and relaying that data to a smartphone, a computer, the cloud or any other device for display and processing.

In a preferred configuration, the resistance unit comprises an elongated platform or base plate having a pair of concentrically acting, independent resistance modules at opposite ends of the platform. These resistance modules are capable of providing a wide range of resistance, from low to very high. Often free weights are provided as plates or dumbbells in the range of about 1-2 pounds to more than 100 pounds, and when multiple free weights are combined, an athlete might perform exercises with total weights exceeding several hundred pounds. Each resistance module generates variable resistance that can reproduce resistance that spans this range of weights. Each of the resistance modules have a respective cable that may be extended and retracted by a respective body part, such as the left and right arms or legs of a user. While the two resistance modules are actuated independently and separately by the individual body parts being exercised, the pull cords could be interconnected and be moved by a single body part driving both pull cords simultaneously.

As each pull cord is extended and retracted during an exercise, the resistance unit is able to collect data on the physical parameters exhibited by the resistance unit In one aspect of the invention, the inventive bench system is usable in combination with the resistance module for the performance of a wide variety of exercises that typically would be performed using multiple exercise machines. The software application analyzes and generates performance data for any of such exercises performed with the resistance unit and generates performance data that is analyzed regardless of the workout being performed.

To permit performance of a wide variety of exercises with the same resistance unit, the inventive exercise system preferably comprises an inventive bench unit, which is similar to a fixed flat bench in one configuration, but is configurable in various bench configurations including flat, seated, incline and decline configurations as well as a sliding seat configuration. In addition to the bench unit, the exercise system includes an extension unit that is adjustably and removably mountable to the front of the bench unit so that additional exercises may be performed with or separate from the bench unit.

The resistance unit is mountable to the bench unit or the extension unit in a plurality of mounting positions that align with the various bench configurations to permit the performance of a wide variety of resistance exercises while varying the angle of resistance generated by the pull cord on the body party being exercised. The mounting positions optimize the location of the resistance unit and the pull cords depending upon the bench configuration to vary and optimize the angle of resistance applied to the user's muscles and body parts during exercises. The inventive exercise system is usable by athletes of all skill levels but is particularly valuable for advanced athletes who might perform variations of a particular exercise to hit different muscles in an area of the body.

In more detail, the mounting positions allow for the pull cord to be extended in multiple vertically and horizontally extending orientations, so that exercises on the exercise system mimic common exercises, such as various presses, flies, rows, curls, squats, lifts, and the like. While the pull cord may be pulled upwardly for certain exercises, the resistance unit may also be mounted to permit downward pulling of the pull cord for other exercises such as pull-downs, curls and the like. Exercises may be done fast or slow. In these configurations, the resistance module may be positioned in lo, hi or intermediate positions either by locating the resistance unit directly in one of these positions, or virtually, through the use of pulleys and/or accessory cables, which here again, permits the performance of a wide variety of exercises using one or only a few resistance modules. As such, the resistance unit and the associated software application are usable to analyze a wide variety of different types of exercises, and are not restricted to a small subset of exercises.

The extension unit may also include a display monitor that displays data associated with the inventive exercise system in real time while the exercises are being performed. In this regard, the resistance unit tracks various parameters of the pull cords to track athlete's performance and displays such information through a software application displayed on the monitor. The monitor may also face away from the bench if the resistance unit is operated from the front side of the extension unit that is opposite to the bench.

In further aspects of the present invention, the compact high resistance unit may include sensors for momentum, direction, and biometrics for procuring data to be processed. Such sensors are commercially available and provide any number of possible data collection capabilities. Once data collection is enabled by the use of non-electronic, electronic means or by the incorporation of sensors, the resistance module may be controlled manually, electronically, by computer or by voice actuation. The compact high resistance fitness device may also include at least one wireless transmission and receiver to relay data and information to a smartphone, a computer, up into the cloud, or any other desirable receiver for data for processing of the data by the software application and an associated computer-based processor. Each of the components, including the handles or foot holds, may become smart handles with sensors embedded therein for relaying additional data. Various commercially available biometric devices can also be incorporated into the smart handles to monitor things like blood pressure, temperature, even cholesterol or blood sugar levels.

For collection of the data, the resistance module may include electronic sensors, circuitry, a CPU and/or communication devices that allow the resistance unit to record the number and length of pull cord strokes, the timing of the pull cord strokes in the extensions and/or retraction strokes, the set resistance force of each said pull cord stroke and compile these values from the at least one resistance module and transmit this information to a receiving device that will record and display the information to the user. Where two resistance modules are being used, the resistance modules may communicate wirelessly between modules and one module will be designated to communicate wirelessly with a user supplied receiving device. The exercise system includes a software application which receives and analyzes data received from the resistance unit and generates a graphical user interface on a display unit for optimized display and representation of real time training data and an interpretation of the results.

Other objects and purposes of the invention, and variations thereof, will be apparent upon reading the following specification and inspecting the accompanying drawings.

BRIEF DESCRIPTION OF THE DRAWINGS

FIG. 13 is a chart that represent aspects of velocity training according to the present invention wherein the power and velocity detected by the resistance modules indicate different states of physical performance and impact and the types of results therefrom.

FIG. 16 illustrates a third aspect of heart rate training involving monitoring heart rate zones wherein target heart rate zones are tracked to achieve fitness goals.

Figure 1:
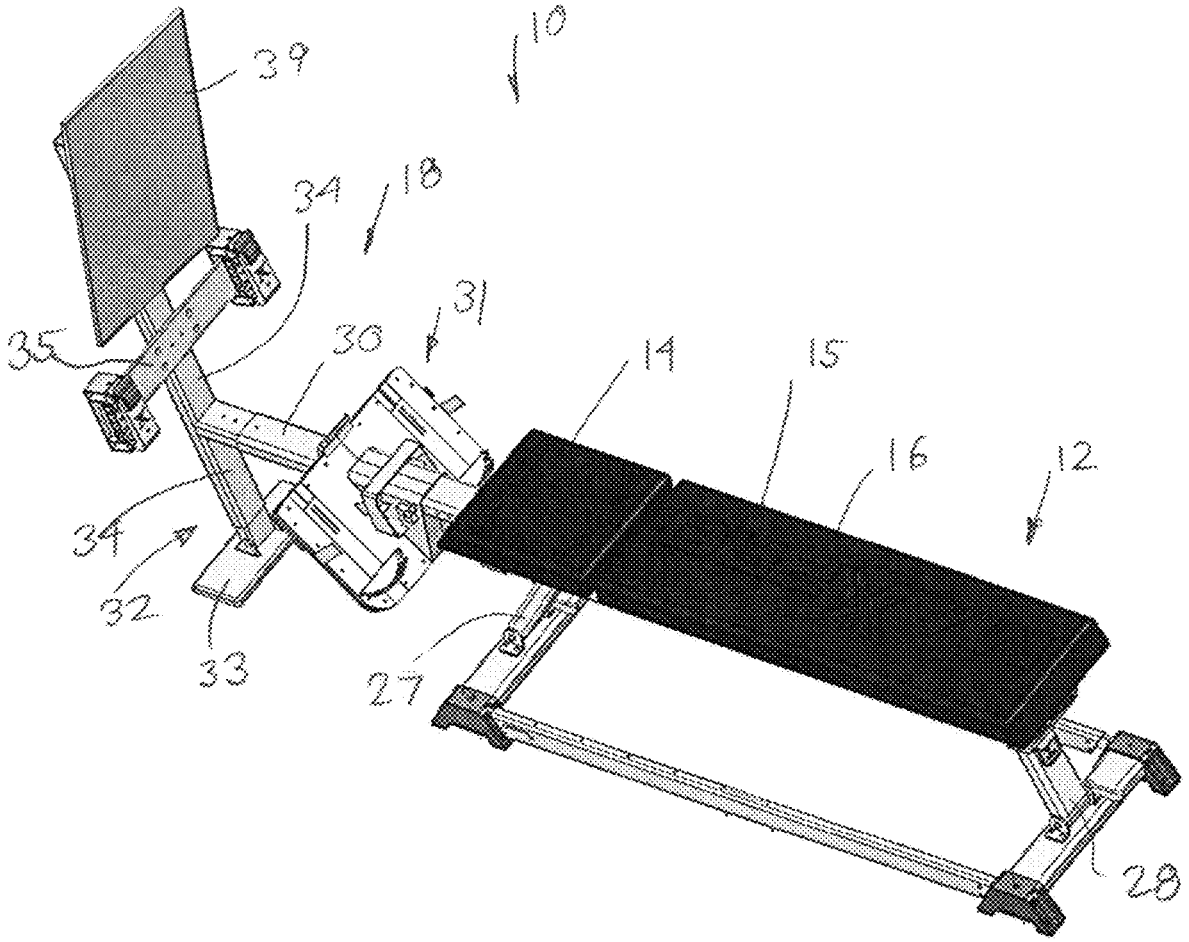
FIG. 1 is a perspective view of an exercise system according to the present invention comprising a bench unit and a front extension unit.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the inventive exercise system includes a software application which receives and analyzes data as a user or athlete uses the exercise system 10. As noted, the software application is usable with a wide variety of exercises performed with the exercise system 10. For example, the exercise system 10 may allow for the performance of a wide variety of workouts or exercises by incorporating an inventive bench unit 12 having a seat 14 and seatback 15, which are similar to a fixed flat bench in one configuration (FIG. 1). However, the seat 14 and seatback 15 are configurable in various bench configurations including: flat with the seat 14 and seatback 15 lying flat (FIG. 1); seated with the seatback 15 upright to its forwardmost position; inclined with the seatback 15 in one of several inclined positions (FIG. 12) and declined with the legs folded so that the bench surface 16 declines from front to back, as well as a sliding seat configuration (FIG. 2) as disclosed in more detail herein.. In addition to the bench unit 12, the exercise system 10 includes an extension unit 18 that is adjustably and removably mountable to the front of the bench unit 12.

Figure 2:
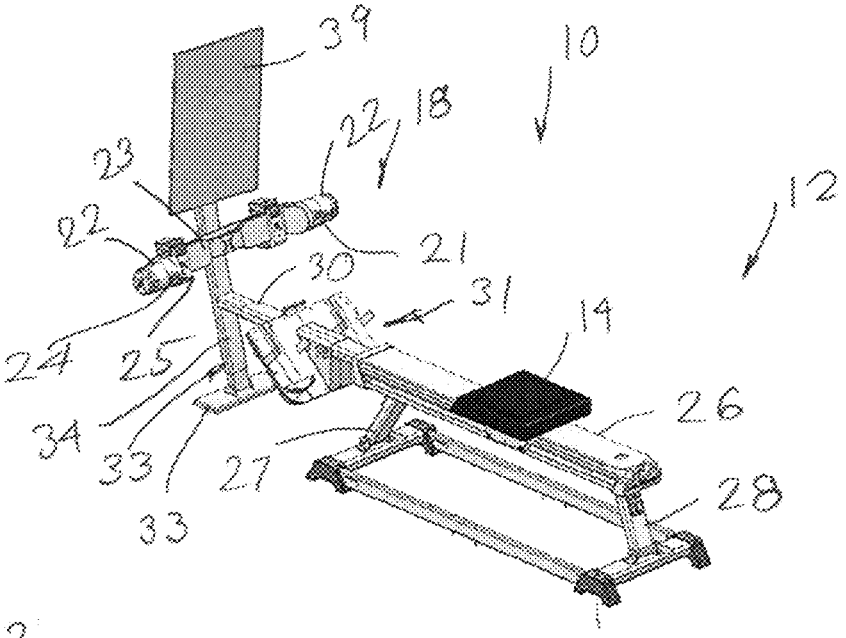
FIG. 2 is a perspective view of the exercise system with a seatback removed from the bench unit.
Figure 3:
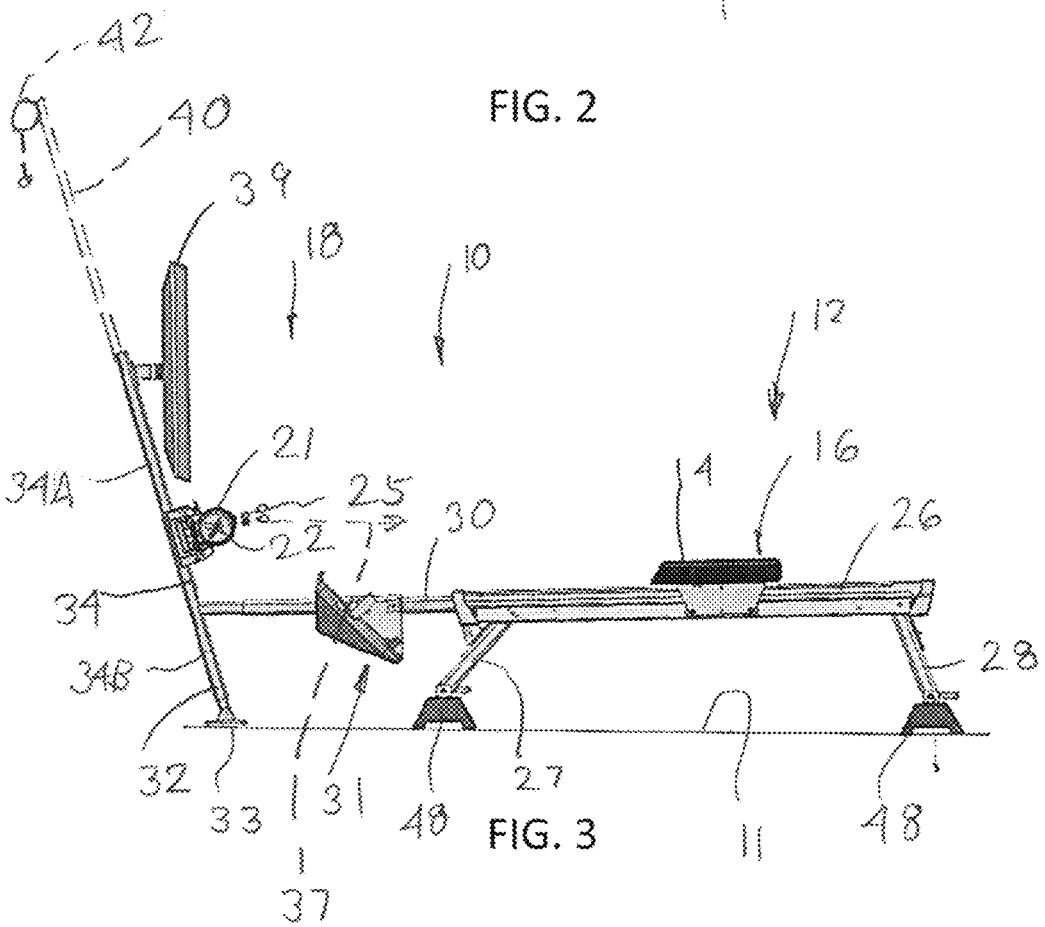
FIG. 3 is a side view of the exercise system with the seatback removed.

Referring to FIGS. 2 and 3, the bench system 12 is usable in combination with a resistance module 21 such as that referenced above for the performance of a wide variety of exercises that typically would be performed using multiple exercise devices. The inventive exercise system 10 allows numerous exercises to be performed by combining the resistance unit 21 with the bench system 12 as will be apparent from the following disclosure.

In one configuration, the resistance unit 21 may be of the type disclosed in PCT Application Publication No. WO 2020/014667 A1, the disclosure of which is incorporated herein by reference in its entirety. In a resistance unit 21 as disclosed herein and shown in FIGS. 2, 3 and 8, the resistance unit 21 comprises one or more resistance modules 22 supported on an elongated platform or base plate 23, which may be foldable or may have a fixed length. The base plate 23 preferably has a pair of concentrically acting, independent resistance modules 22 at opposite ends of the platform 23. These resistance modules 22 are capable of providing a wide range of resistance, from low to very high and each have a respective cable 24 that may be extended and retracted by a respective body part, such as the left and right arms or legs of a user. While the two resistance modules 22 operate independently and separately by the individual body parts, the pull cords 24 could be interconnected and moved by a single body part driving both pull cords 24 simultaneously.

For an understanding of the present invention, each of the resistance modules 22 includes a coil storage spool configured to wrap and unwrap the pull cord 24 emanating from the resistance module 22. The high strength pull cord 24 terminates at its outer end with a connector 25 that may connect to a handle, such as a hand/foot receptacle, or other exercise implements, wherein the pull cord 24 has a length sufficient to allow pull strokes with a length suitable for use with any of the exercises that may be performed using the inventive exercise system 10. Further, the resistance module 24 generates a variable amount of weight resistance so that the single resistance module 24 can provide as little or as much weight-like resistance as a user could want in a compact and portable unit.

Of special interest is that the fitness device may include sensors and other means for collecting data and relaying that data to a smartphone, a computer, the cloud or any other device for display and processing. For collection of the data, the resistance module 21 may include electronic sensors, circuitry, a CPU and/or communication devices that allow the resistance unit 21 to record the number and length of pull cord strokes, the timing of the pull cord strokes in the extensions and/or retraction strokes, the set resistance force of each said pull cord stroke and compile these values from the at least one resistance module and transmit this information to a receiving device that will record and display the information to the user through interaction with the inventive software application. Other data sources may also be integrated within the system such as heart rate monitors and the like.

As disclosed herein, the inventive exercise system 10 is particularly suitable for a wide variety of such exercises while relying upon a single resistance unit 21 using one or two resistance modules 22. While only one resistance unit 21 is preferably provided for cost efficiency, it will be understood that multiple resistance units 21 might be provided, or the resistance units 21 might have only one resistance module 22 rather than two or more. Of particular note, the resistance unit 21 is readily repositionable on the bench unit 12 in a variety of positions as disclosed in more detail herein. The resistance unit 21 also may be dismounted for use by itself, since the resistance unit 21 allows the performance of a variety of exercises even when used without other system components such as the bench unit 12 or extension unit 18.

Generally, as to the bench unit 12 as shown in FIGS. 1-3, the bench unit 12 comprises a main beam 26, which slidably supports the seat 14 thereon, and also supports the seatback 15 thereon. As will be described further below, the seatback 15 may lie flat, be inclined or even be removed depending upon the exercise being performed. The main beam 26 is supported on front and back legs 27 and 28, which are extendible for use as shown, and foldable to a variable angle to adjust the bench angle or foldable to a stored position for storage.

Next, the extension unit 18 includes a support rail 30 that can be removably fixed to the front end of the bench unit 12. The support rail 30 includes a foot support or foot stretcher 31 that anchors the feet of the user when sitting on the bench unit 12 and includes a front support frame 32 on the front distal end thereof. The front support frame 32 has a foot pad 33 and an upright 34 configured to support the resistance unit 21 thereon (FIGS. 2 and 3) by a mount 35. The mount 35 is configured to support the resistance unit 21 in an intermediate position at an elevation just above the foot stretcher 31, wherein the pull cord 24 may extend horizontally toward the bench unit 12 as indicated by reference arrow 37 (shown in phantom outline). If desired, the resistance unit 21 may be flipped with the pull cords 24 extending in the direction opposite reference arrow 37 toward the front of the extension unit 18.

When the seat 14 is fixed as in FIG. 1 and the user faces away from the bench unit 12 toward the upright 34, the user may perform exercises such as seated rows. The user may also reverse their position on the seat 14 and face away from the upright 34 for performing exercises that press the pull cord 24 in direction 37 if so desired. When the seatback 15 is removed, the seat is reconfigured to a sliding seat configuration as seen in FIGS. 2 and 3 wherein the seat 14 can slide away and toward the front end of the bench unit 12. As such, the exercise system now operates as a rowing machine when the pull cord 24 is extended and retracted in direction 37, wherein the athlete can perform a rowing technique through a full range of a conventional rowing stroke including the drive, recovery and catch.

The extension unit 18 may also include a display monitor 39 on the upper end of the upright 34, wherein the monitor can display data associated with the inventive exercise system 10. In this regard, the resistance unit 21 tracks various parameters of the pull cords 24 to track athlete performance and displays such information through a software application displayed on the monitor 39. The monitor 39 may also display third party exercise programs to either read back performance data or watch video feeds of motivational exercise programs. The monitor 39 may also be repositioned to face away from the bench unit 12 if the resistance unit 21 is operated from the front side of the extension unit 18, which is opposite to the bench unit 12.

The extension unit 21 may also include a mast 40 that extends upwardly from the upright 34 and allows the resistance unit 21 to operate in a hi configuration. The resistance unit 21 might be located directly in a hi position on the mast 40 as indicated by reference numeral 42. For descriptive purposes, the reference numeral 42 may identify a resistance unit 21 mounted hi on the mast, wherein its respective pull cord 24 would extend downwardly for use in strength training exercises or as a ski erg or ski machine or for resistance exercises such as pulldowns or reverse curls. The reference numeral 42 might alternatively indicate a pulley, wherein the resistance unit 21 is positioned in the intermediate position shown in FIG. 2 but operates vertically as if it was in a hi-position through the provision of one or more pulleys and cables extending vertically from the pull cords 24 up to a hi pulley and then down to the athlete for use in strength or ski training. When exercising on this front side of the extension unit 18, various weightlifting exercises can be performed. Further, the length of the pull cord 24 and its resistance characteristics allows the pull cords 24 to be repetitively extended and retracted in a skiing motion so that the inventive exercise device 10 can operate as a ski erg or ski machine whether the resistance unit 21 is in the intermediate position shown or the hi position indicated by reference numeral 42.

Figure 4:
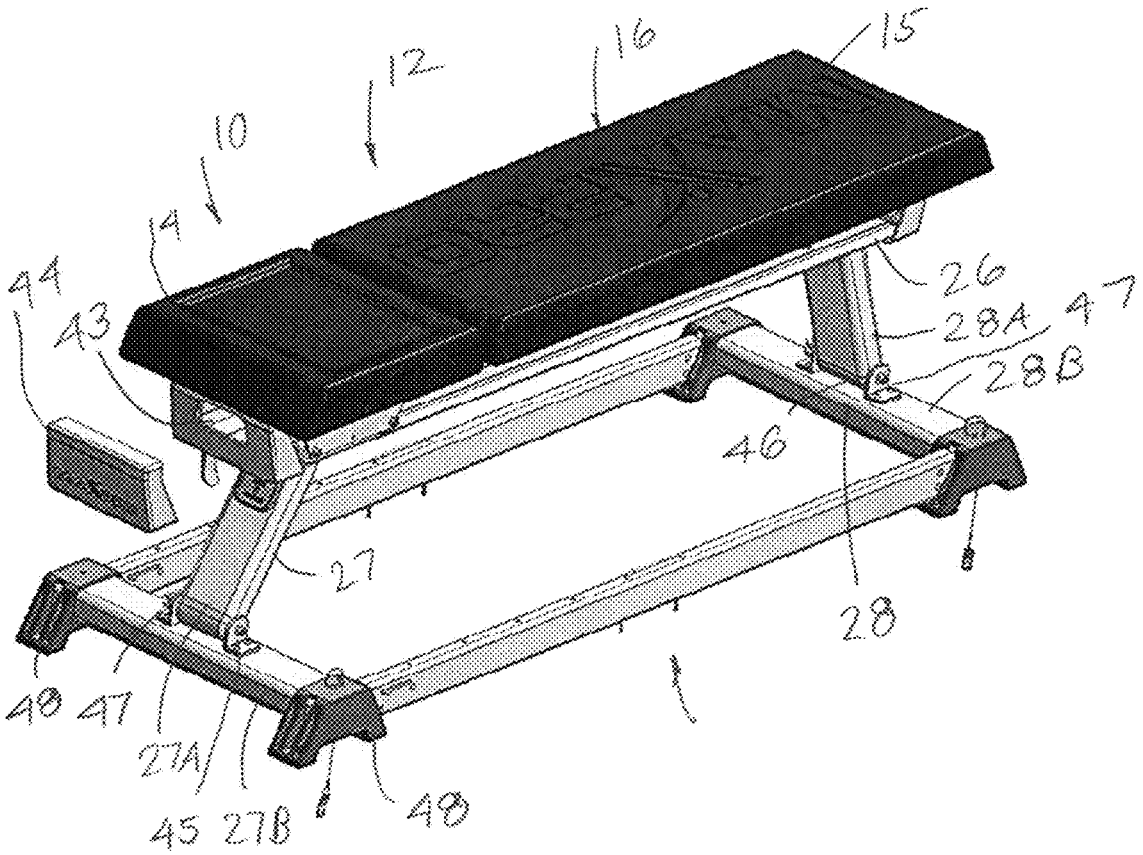
FIG. 4 is a perspective view of the bench unit.
Figure 5:
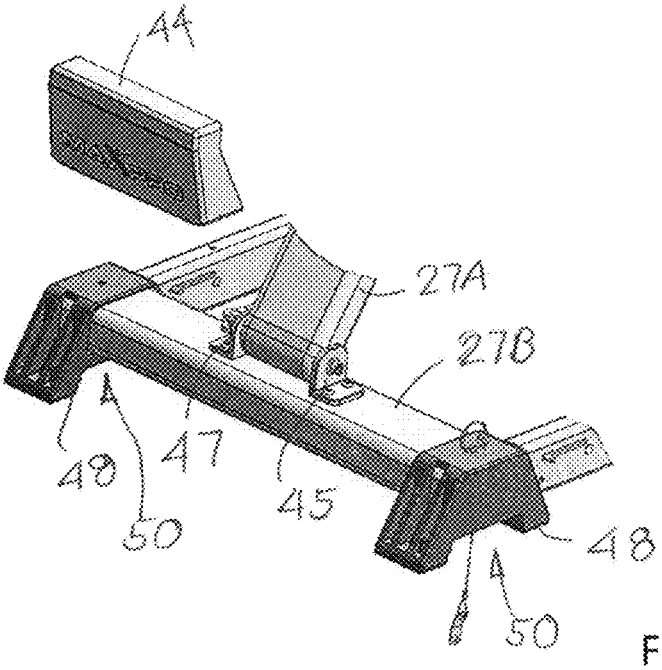
FIG. 5 is a partial view of a front leg of the bench unit.
Figure 6:
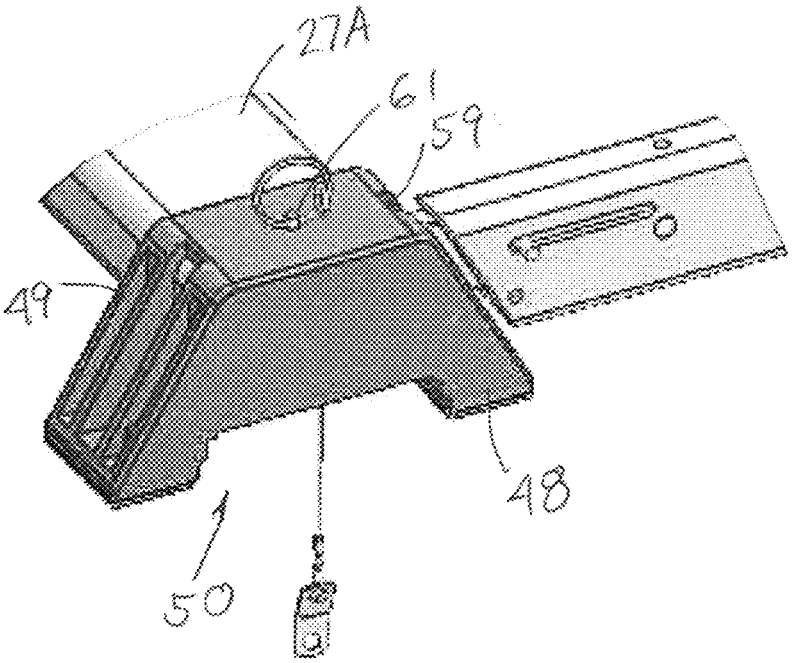
FIG. 6 is an enlarged fragmentary view of FIG. 5.

The front and back legs 27 and 28 may project downwardly as seen in FIG. 4 and include leg posts 27A and 28A and cross bars 27B and 28B, which are respectively joined together by pivot joints 45 and 46. This allows the cross bars 27B and 28B to conform to the floor 11 surface depending upon the angles of the front and back legs 27 and 28. Further, lock units 47 are provided to fix the angle of the cross bars 27B and 28B. The opposite ends of the cross bars 27B and 28B each include a foot block 48 as seen in FIGS. 5 and 6 that is configured to contact the floor surface 11. Each foot block 48 has a main body 49 that fits sidewardly onto a respective end of a cross bar 27B or 28B and in turn defines a downward opening channel 50 that is configured to fit over the platform 23 of the resistance unit 21.

Figure 7:
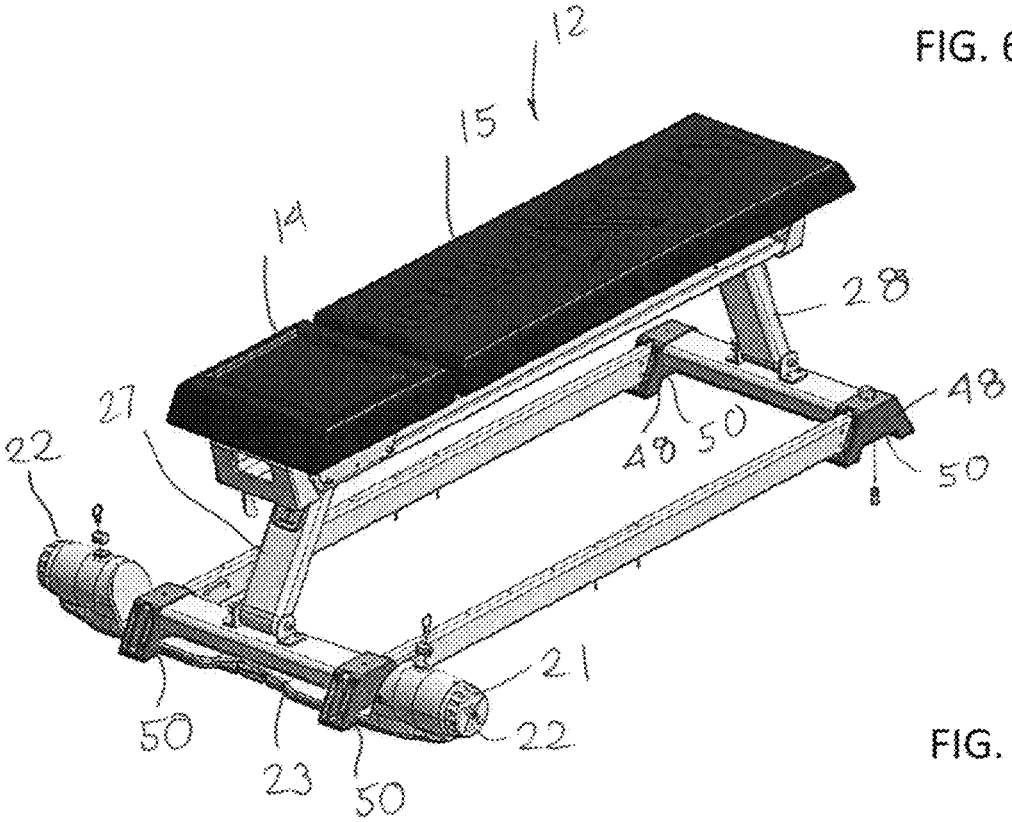
FIG. 7 is a perspective view of the bench unit in combination with a resistance unit in a forward, low position.
Figure 8:
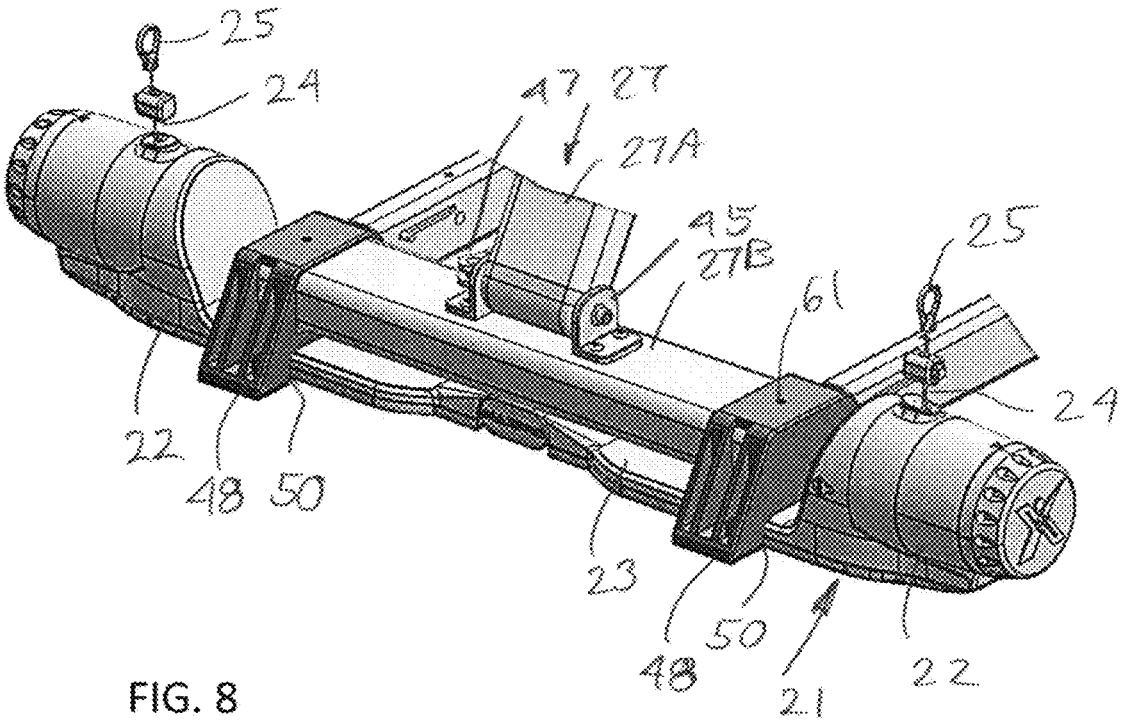
FIG. 8 is an enlarged fragmentary view of FIG. 7.

Referring to FIGS. 7 and 8, the resistance unit 21 may be placed on the floor 11 and then the foot blocks 48 dropped over the platform 23. The channels 50 confine the resistance unit 21 and prevent movement upwardly, forwardly and rearwardly, as well as sidewardly since the resistance modules 22 lie on the outside of the foot blocks 48. The downward force generated by the user on top of the bench unit 12 including the counterforce generated during exercise restrains the resistance unit 21 vertically such that it is not necessary to fasten the bench unit 12 to the floor. In other words, the user during exercise pushes upwardly which generates a lifting force on the resistance unit 12, but at the same time, the user generates a downward counterforce that is opposite to and counters the lifting force so that the resistance unit 21 is restrained upwardly by the foot blocks 48.

FIGS. 7 and 8 show a forwardmost lo position for the resistance unit 21 when engaged with the front foot blocks 48 of the bench unit 12. The channels 50 on the back foot blocks 48 of the back legs 28 also define another lo position, i.e., the rearmost lo position on the bench unit 12.

Therefore, the extension unit 18 defines one or more mounting locations for the resistance unit 21, which may be intermediate or hi positions, while the bench unit 12 defines additional lo positions for locating the resistance unit 21. In this regard, the front and back legs 27 and 28 are configured to restrain resistance unit 21 in the forwardmost and rearmost lo positions defined by the pairs of foot channels 50 on the front and back legs 27 and 28.

Figure 9:
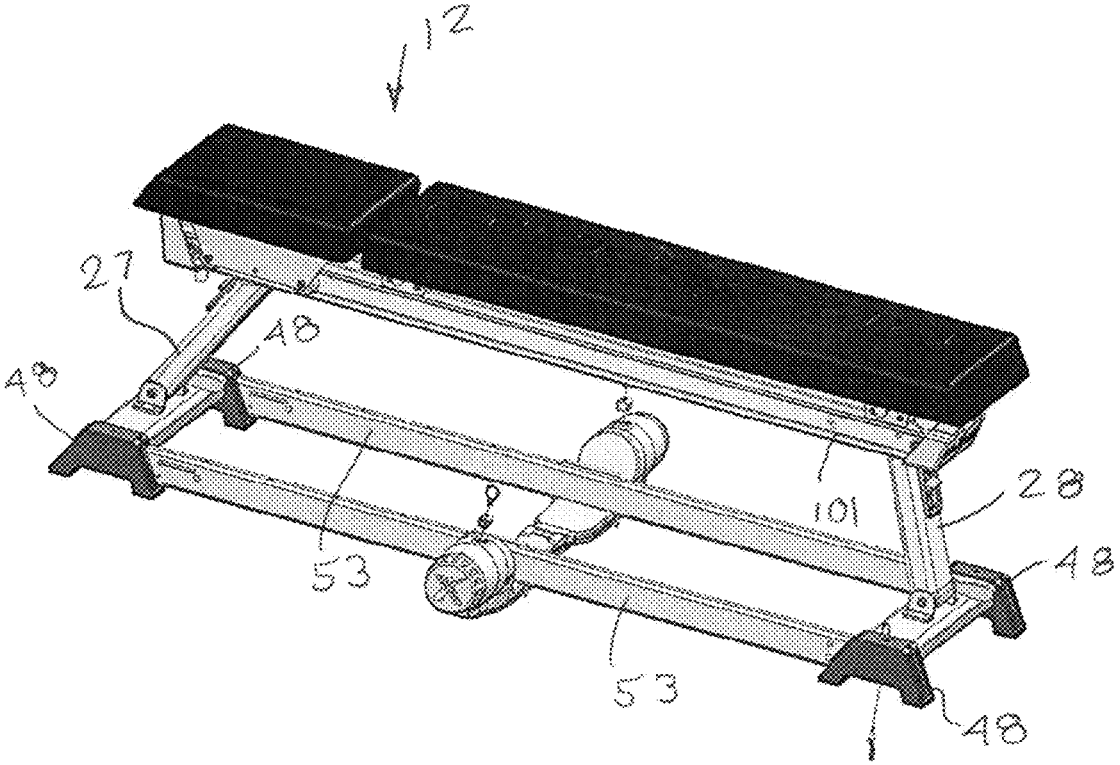
FIG. 9 is a perspective view of the bench unit with the resistance unit in an alternate lo position.
Figure 10:
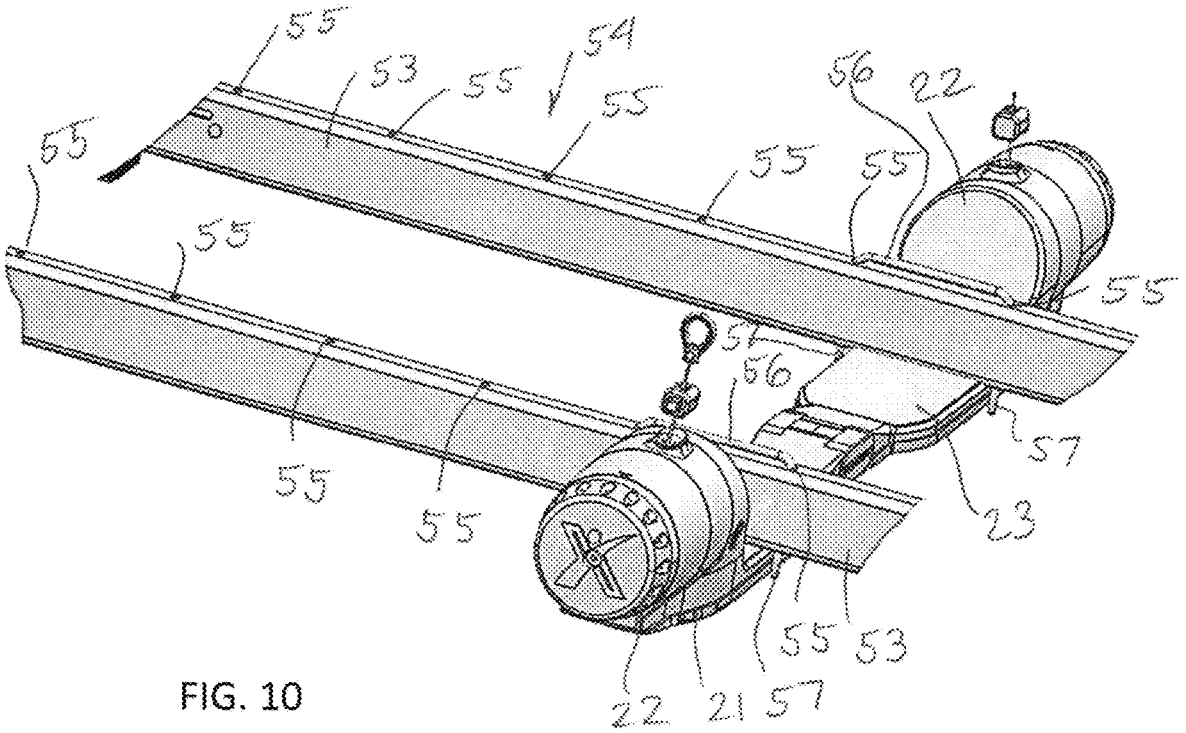
FIG. 10 is an enlarged fragmentary view of FIG. 9.

Further, the bench unit 12 defines additional lo positions between the forwardmost and rearmost lo positions described above. In this regard, FIGS. 9 and 10 illustrate the bench unit 12 with the resistance unit 21 in one of several alternate los positions. In more detail, the bench unit 12 preferably includes a pair of locator rails 53, which have their opposite ends removable engaged with the foot blocks 48. The locator rails 53 are raised above the floor level so that the platform 23 of the resistance unit 21 can pass underneath as seen in FIGS. 9 and 10. Here again, the downward force generated by the user on the bench unit 12 prevents the bench unit 12 from lifting and thereby restrains the resistance unit 21 vertically. Effectively, each resistance unit 12 is captured vertically between the floor 11 and the bench unit 12, and the bench unit 12 is prevented from lifting by the counterforce generated by the user's muscles during exercise, so that additional fasteners and locks are not required to restrain vertical movement.

Figure 11:
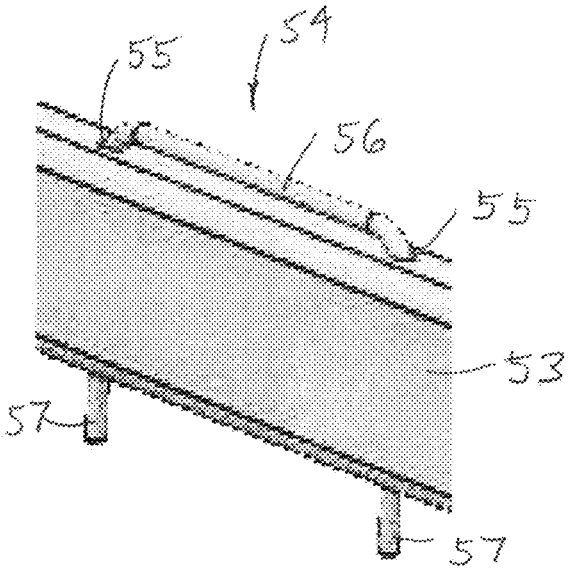
FIG. 11 is an enlarged fragmentary view of FIG. 10.

To confine the resistance unit 12 in the forward and rearward directions, locking formations 54 are provided to lock the horizontal position of the resistance unit 21. In the preferred embodiment, the locator rails 53 include spaced vertical bores 55 that cooperate with a U-shaped lock member 56. The ends of the side legs of the lock member 56 project downwardly out of the locator rail 53 as seen in FIG. 11 to thereby confined horizontal movement of the resistance unit 21. Essentially these locking formations 54 comprise the bores 55 and lock member 56 to define multiple, incrementally-spaced, lo positions in which the resistance unit 21 may be positioned along the length of the locator rails 53. It will be understood that other devices may be used. For example, the locking formations 54 might comprise horizontal slots and lock structures that engage the slots.

In use, only one resistance unit 21 need only be provided since it is readily positionable at any of the hi, lo or intermediate positions described above. However, two or more resistance units 21 may be provided simultaneously on the exercise device 10.

As such, the resistance unit 21 is mountable to the bench unit 12 or the extension unit 18 in a plurality of mounting positions that align with the various bench configurations to permit the performance of a wide variety of resistance exercises while varying the angle of resistance generated by each pull cord 24 on the body party being exercised. The mounting positions optimize the location of the resistance unit 21 and the pull cords 24 depending upon the bench configuration to vary and optimize the angle of resistance applied to the user's muscles and body parts during exercises. The inventive exercise system 10 is usable by athletes of all experience levels and is particularly suitable for advanced athletes who might perform variations of a particular exercise to hit different muscles in an area of the body.

In further aspects of the present invention, the resistance unit is configured to collect data from the resistance modules 21 during use and convey such data to the software application of the present invention. Examples of data collection are provided in the resistance unit 21 are disclosed in PCT Application Publication No. WO 2020/014667 A1, the disclosure of which is incorporated herein by reference in its entirety. When incorporated into the present invention, the resistance unit 21 may include sensors for momentum, direction, timing and biometrics for procuring data to be processed. Each of the components, including the handles or foot holds, may become smart handles with sensors embedded therein for relaying medical data. Various commercially available biometric devices can also be incorporated into the smart handles to monitor things like blood pressure, temperature, even cholesterol or blood sugar levels.

When collection of the data is desired, the resistance module may include electronic sensors, circuitry, a CPU and/or communication devices that allow the resistance unit to record the number and length of pull cord strokes, the time cycle for the retraction and extension strokes of the pull cord, the set resistance force of each said pull cord stroke and compile these values from the at least one resistance module 21 and transmit this information to a receiving device that will record and display the information to the user through implementation of the software application of the present invention.

The software application of the present invention is generally understood with reference to FIGS. 12-20. The software application receives the data generated by the resistance modules 22 and analyzes such data to determine performance metrics for the athlete and generates a real-time representation of the data. The inventive software application is a sophisticated fitness and performance tracking app developed for beginner and elite athletes alike who want to achieve their fitness goals in the most efficient and effective way possible. The inventive application is a high performance platform, which enhances the digital fitness experience resulting from use of the resistance units 21 during training.

Figure 17:
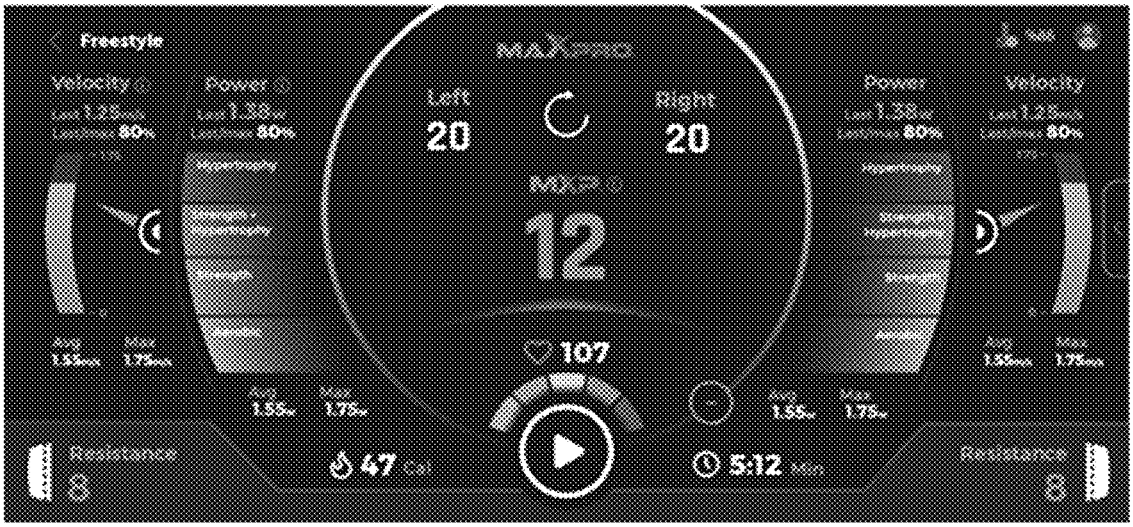
FIG. 17 illustrates a dashboard of the inventive software app used in association with the resistance units to drive a workout based upon the improved UI or dashboard.

The software application receives, and processes the performance data and generates an improved graphical user interface (UI) on the monitor 39 by generating a performance dashboard as seen in FIG. 17 that is displayed as a workout visualization UI (user interface) incorporating real time data and interpretative data generated therefrom. As described herein, the resistance unit 21 incorporates inventive power clutch technology, which is based on the science of Concentric Biased Resistance (CBR) Training. Further, the performance app processes the data generated by the resistance modules 22 during exercise and incorporates Velocity Based Training (VBT) processes in combination with Heart Zone Optimization (HRO) processes to assess in-exercise performance and improvements over time and thereby, precisely guide user energy systems to achieve optimum results faster. During processing of the exercise data, the processor associated with the software application processes every rep of every set, which data is analyzed in depth to assess if the user is staying in one of 4 velocity zones (Speed/Aerobic, endurance, strength, muscle build) and 5 heart rate zones (warmup, calorie burn, endurance, cardio), wherein the target zones may depend upon the users desired workout optimization goal.

The software application processes the data and generates performance results in an optimized form such that those looking to build muscle can now see and maximize the number of actual contribution reps going towards building muscle or other target phases such as strength or power. The interpretive data generated by this inventive performance application can be used by beginning and elite athletes alike and their trainers and coaches. Such data can also be used for physical therapy and musculoskeletal rehabilitation The performance software application includes a number of innovative features including:

UI/UX—Digital Experience
More robust platform—reduced crashes, more secure
More reliable Bluetooth connectivity
Easier to navigate
Simple, clean modern design
Quick access to favorites and most popular classes
Quick connect and battery level from any screen
Cable Life Gauge—easy reorder button
Workout filter options
Improved Calendar workout scheduling
Tutorial videos
Data export function CSV file
Fitness Experience
Recommended workouts based on individual goals
Freestyle Data Display
Quick Start button
Dynamic workout feedback
Detailed Performance tracking screen
Coached Class
Coached classes of all types and levels
Added detailed Performance tracking screen
Realtime leaderboard (Friend group or global ranking)
Pause/Play/Rewind/FF workouts
Download classes for quick play anywhere
BYO
Improved preset workouts and visual interface
All new exercise library to build personal workouts
Improved filtering and selection
Create and insert personal workouts with video
Added calendar and scheduling of BYO workouts
Carry over circuit/station and rep/time based programming
Programs
Multi-day/week—Auto calendar fill
Objective/Muscle specific goal oriented programs
Friends Only Challenge—Private group
Online Live workouts Library
Gamification/Leaderboards
General—with "Real Time" Leaderboard
Friends—Real time results in private room leaderboard Sharing of results (social, etc.)
Achievement Medals/Awards
Music Player—In workout Music experience
Curated Wellness Content
Grouped results for comparison over time of same exercise In more detail, the inventive software application also analyzes the exercise data to generate interpretative performance data for display in an improved UI, including:

A proprietary MXP score as the basis for performance and tracking across all workouts and ranking on global leaderboards
Velocity Based Training (VBT) live visual display
Heart Rate Zone (HRZ) training live visual display
Detailed Instantaneous rep graph for peak and % velocity and power over rep
Results/Analysis
Heart Rate Zone by time
Energy Systems by time and reps
Hypertrophy focused contribution rep chart
More specifically, heart zone training is based upon the following general zones in which a heart rate is detected during an exercise. Each zone is based upon the actual heart rate in comparison to a calculated maximum heart rate based upon age in a known manner.

Exemplary Heart Rate Zone Chart:

Gray Zone (50-60% Maximum Heart Rate)—This is the least strenuous, most comfortable zone, consisting of very light activity.

Blue Zone (61-70% Maximum Heart Rate)—This zone is specifically geared for warm-up and cool-down exercises. You are preparing your body and mind for high-intensity interval training, but you haven't unleashed the burn just yet.

Green Zone (71-83% Maximum Heart Rate)—in this zone, you have reached a challenging but double pace. This is what Orangetheory categorizes as "Base Pace," a pace you can maintain for 20-30 total minutes. Your body starts to burn fat and carbohydrates evenly.

Orange Zone (84-91% Maximum Heart Rate)—This is where the magic happens and where you achieve "EPOC" (Excess Post-Exercise Oxygen Consumption)—what we call the "Orange Effect/Afterburn." The goal is to accumulate 12 minutes or more in this zone within a 60-minute period to achieve the maximum caloric burn for up to 24 hours AFTER your workout is completed.

Red Zone (92-100% Maximum Heart Rate)—This zone happens organically and may be achieved during 'All Out' efforts when you're emptying the tank and using every ounce of energy left in your body. You don't need to set an All Out pace for more than 1 minute at a time to experience maximum results.

Figure 12:
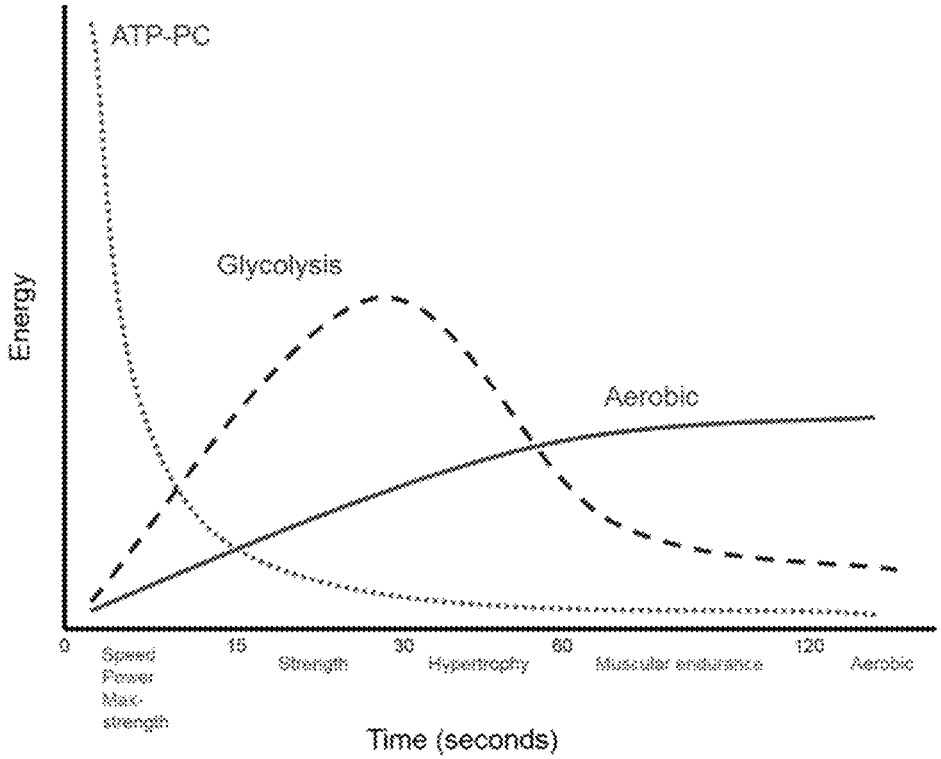
FIG. 12 is a graph that diagrammatically displays the results of velocity based training according to the present invention that are achieved depending upon the energy and time expended during an exercise.

Velocity based training according to the present invention generally differs and is represented by the chart of FIG. 12 which diagrammatically displays the results that are achieved depending upon the energy and time expended during an exercise.

The two training concepts are generally similar in that they are monitored to increase some aspect of the broad spectrum of fitness. FIGS. 12 and 13 represent aspects of velocity training according to the present invention wherein the power and velocity detected by the resistance modules 22 indicate different states of physical performance and impact and the types of results therefrom. Generally, the velocity based training monitors the velocity and power on the pull cords 24 during extension and retraction to determine and initial power and velocity during an initial rep and then monitors velocity decrements or decreases over the performance of subsequent reps during a training set. FIG. 13 depicts different phases of a training set wherein lower velocity decrements result in green phase power training, next stage yellow phase decrements represent strength training, orange phase decrements represent impacts upon both strength and hypertrophy and red phase results in impacts on hypertrophy.

Figure 14:
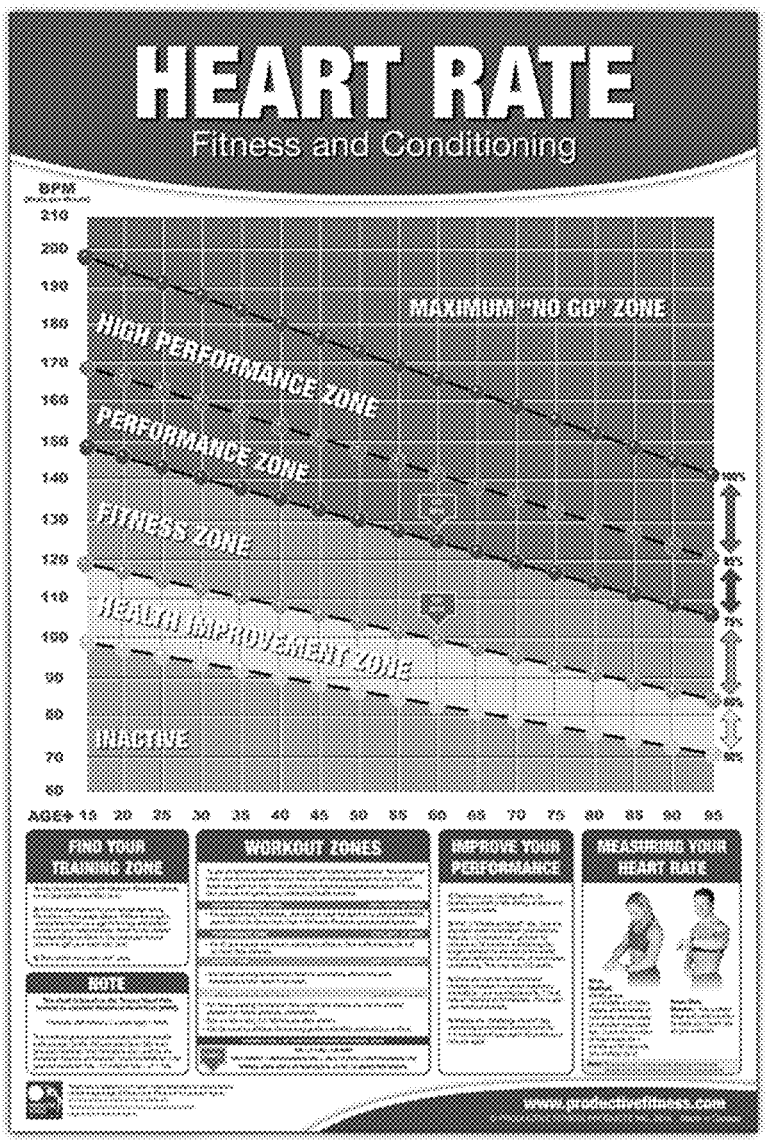
FIG. 14 illustrates a first aspect of heart rate training involving monitoring heart rate zones wherein target heart rate zones are tracked to achieve fitness goals.
Figure 15:
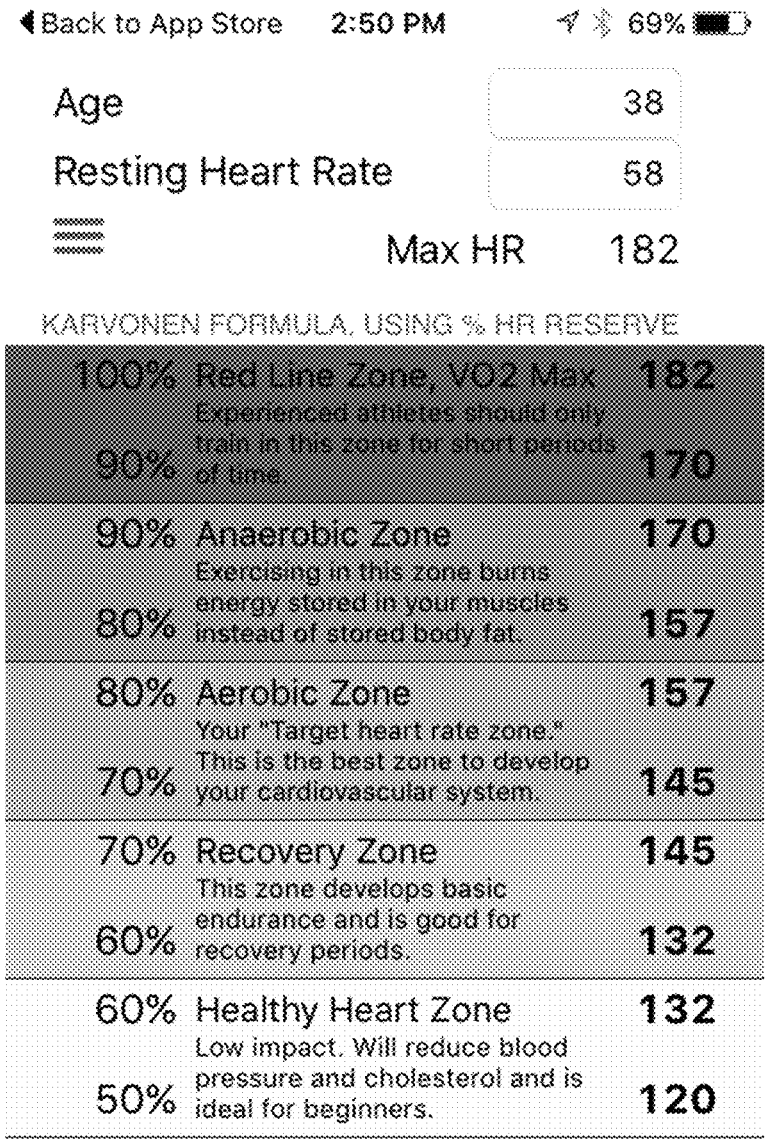
FIG. 15 illustrates a second aspect of heart rate training involving monitoring heart rate zones wherein target heart rate zones are tracked to achieve fitness goals.

The heart rate training depicted by FIGS. 14-16 monitor heart rate zones wherein target heart rate zones are tracked to achieve fitness goals. FIGS. 14-16 represent different theories of targeting the heart rate zones but the principal primarily relies upon heart rate monitoring and maintaining an intensity level during a workout to remain in a target hear rate zone for target time periods.

The present invention relates to use of the inventive software app in association with the resistance units 21 to drive a workout based upon an improved UI or dashboard as displayed in FIG. 17. The improved UI includes data associated with both of the pull cords 24, which typically relate to right and left appendages such as the arms or legs for that matter. The center of the dashboard includes data for both the left and right pull cords 24 and a heart rate displayed at the bottom center. A color arc of different colors may be located below the heart rate to indicate the target heart rate zone that is achieved during the workout. As noted, the heart rate zone indicates target fitness levels but really does not provide a direct indication of whether improvements are generated as to power, strength, endurance, hypertrophy or combinations of such parameters.

The left and right sides of the dashboard also include graphical displays of velocity and power detected through the data generated by the resistance unit 21. The velocity data is depicted in m/s, and the ratio of the last velocity compared to a max rep velocity which are shown numerically and on a dial. The power data is shown in last rep watts, the ratio of last/max and in comparison to a graph of whether the power data falls in the Aerobic phase, Strength phase, Strength-Hypertrophy phase, and the Hypertrophy phase, which is determined through the velocity decrement being detected through the resistance unit data. Further the average and max power watts and velocities are also shown.

Similar graphical representations are shown for both the left and right pull cords. By representing power, velocity and heart simultaneously using graphical displays, an athlete can readily monitor their actual performance and adjust their workout in real time to achieve their desired goal, whether it is heart rate based fitness or the velocity based phases, which can vary independent of changes in heart rate. Therefore, the improved software app generates an improved UI that can be used to target specific performance goals during a workout and after reviewing the performance data from a workout session.

Figure 18:
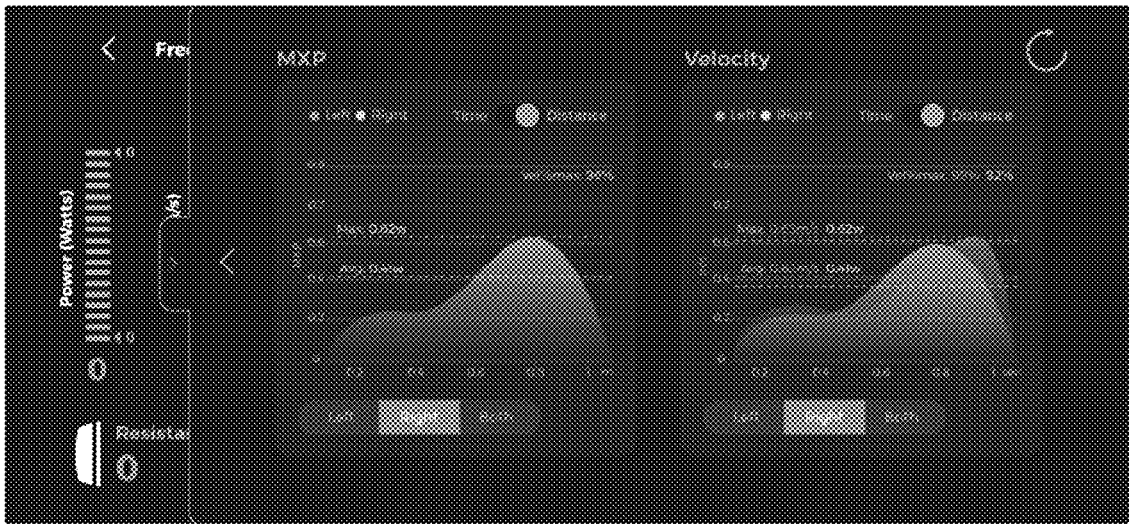
FIG. 18 is another illustration of the dashboard depicting additional fitness data that can be evaluated and reviewed to further assess whether a particular exercise session hits targeted goals for endurance, strength, power or hypertrophy.
Figure 19:
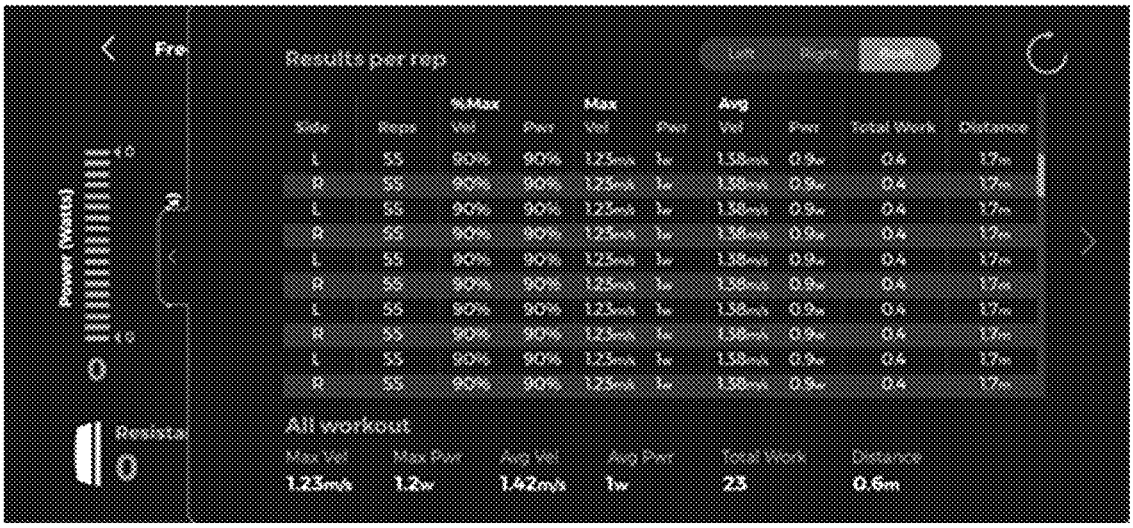
FIG. 19 illustrates additional fitness data.
Figure 20:
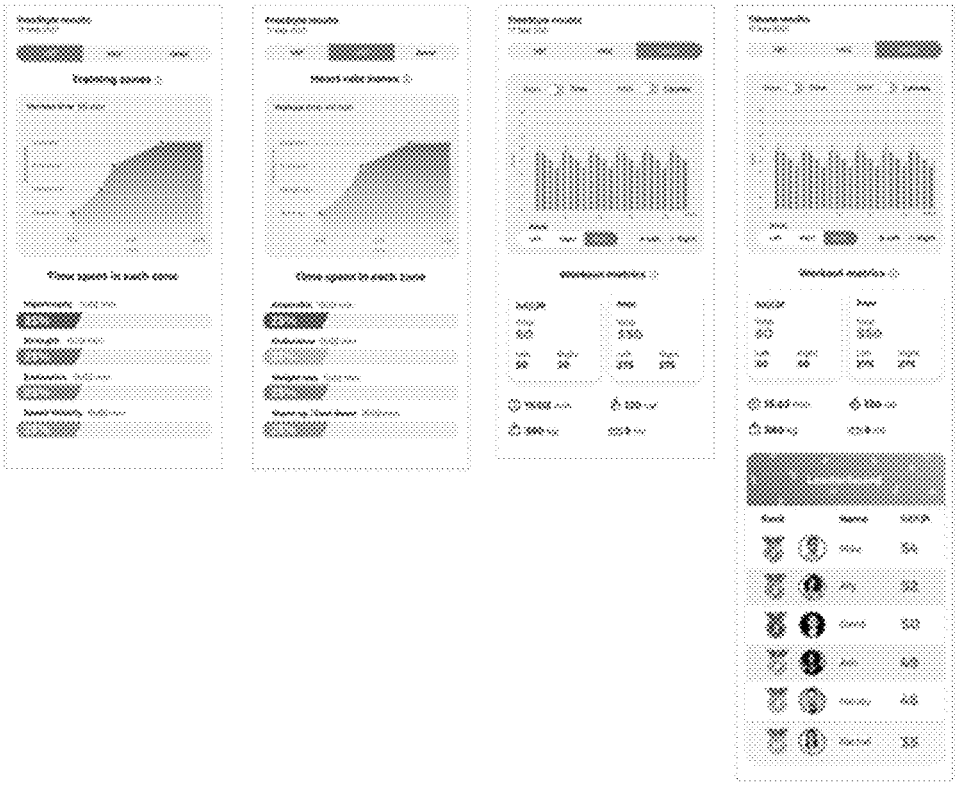
FIG. 20 illustrates additional performance data that can be monitored using the resistance unit of the present invention.

FIGS. 18 and 19 also display additional data that can be evaluated and reviewed to further assess whether a particular exercise session hit targeted goals for endurance, strength, power or hypertrophy. Further, the individual performance of the left and right sides of the body can also be measured. During a workout, the UI in FIG. 17 allows an athlete to potentially focus more on the performance of one side that might be lagging the other side as can be seen during real time use of the dashboard. This compensation might occur during a set or in the next set once an initial set is completed and the data reviewed. FIG. 20 illustrates additional performance data that can be monitored using the resistance unit 21 of the present invention.

As one feature, the inventive app can also determine how many reps of a workout session qualified as contribution reps that contributed to a particular goal. For example, if an athlete performs 20 reps during power training, they may find that only a certain number of reps were performed at a velocity adequate to contribute to power improvements. This allows the athlete to adjust their workout, such as the weight being used, so that more reps served as contribution reps.

Still further, the dashboard UI of FIG. 17 also includes an MXP score in the middle of the dial, wherein the MXP score is a proprietary score calculated from the exercise data that serves as the basis for performance and tracking across all workouts and can be used as a ranking on global leaderboards.

Although particular preferred embodiments of the invention have been disclosed in detail for illustrative purposes, it will be recognized that variations or modifications of the disclosed apparatus, including the rearrangement of parts, lie within the scope of the present invention.

We claim:

1. An exercise system comprising:

an exercise device comprising one or more resistance modules wherein each respective module of said one or more resistance modules includes a coil storage spool configured to wrap and unwrap a respective pull cord emanating from each said resistance module, each said respective pull cord terminating at an outer end which is manually displaceable by a user during exercising, each said resistance unit at least generating resistance to extension of said respective pull cord, and said resistance unit further collecting training data in real time relating to physical movement of said respective pull cord wherein said training data indicates performance characteristics of the user during said exercises;

a graphical user interface of a computing device displaying a performance dashboard, wherein said computing device receives said real time training data generated by physical movement of said respective pull cord and said dashboard displays said real time training data and/or interpretive training data, which is based upon said real time training data, said dashboard having one or more display sections which correspond to a respective said pull cord and include graphical displays of said real time training data and said interpretive training data indicating whether physical performance and said real time training data is providing improvements relating to power, strength, endurance, hypertrophy or combinations thereof; and said interpretive training data being displayed on said graphical user interface as an indicator in combination with a graphical display showing a plurality of exercise phases comprising at least an aerobic phase, a strength phase and a hypertrophy phase wherein said user is capable of adjusting their physical performance in real time to move said indicator to a desired one of said exercise phases.

2. The exercise system according to claim 1, wherein said one or more display sections comprise a first display section and a second display section, and said pull cords comprise a first pull cord and a second pull cord manually operable by left and right appendages of the user, and wherein said first and second display sections correspond respectively to said first and second pull cords.

3. The exercise system according to claim 2, wherein said plurality of exercise phases displayed on said graphical display further comprise a strength hypertrophy phase wherein said user is capable of adjusting their physical performance in real time to move said indicator to said desired one of said exercise phases.

4. The exercise system according to claim 3, wherein said real time training data comprises power data and velocity data, which are processed to generate said interpretive training data for said exercise phases.

5. The exercise system according to claim 3, wherein said graphical display and said indicator is provided for each of the first and second pull cords in a respective one of the first and second display sections to independently represent performance of the appendage displacing respective said first and second pull cords to allow independent adjustment of the exercise performed by each of the appendages and provide feedback in real time as the exercise is performed.

6. The exercise system according to claim 1, wherein said real time data comprises a user heart rate displayed on said graphical user interface.

7. The exercise system according to claim 1, wherein said real time data displayed on said graphical user interface represents power and velocity of said pull cord movement and heart rate of said user simultaneously such that the user is capable of monitoring their actual performance and adjust their workout in real time to achieve their desired goal, whether it is heart rate based fitness or velocity based phases, which can vary independent of changes in heart rate.

8. An exercise system comprising:

an exercise device comprising one or more resistance modules wherein each resistance module of said one or more resistance modules includes a coil storage spool configured to wrap and unwrap a respective pull cord emanating from each said resistance module, each said respective pull cord terminating at an outer end which is manually displaceable by a user during exercising, each said resistance unit at least generating resistance to extension of said respective pull cord, and said resistance unit further collecting training data in real time relating to physical movement of said respective pull cord wherein said training data indicates performance characteristics of the user during said exercises, said exercises comprising at least one repetition of a selected exercise wherein said repetition is performed at a variable velocity and power controlled by the user wherein said velocity and power result in performance impacts on aerobics, endurance, strength, hypertrophy or combinations thereof, a graphical user interface of a computing device displaying a performance dashboard, wherein said computing device receives said real time training data generated by physical movement of said respective pull cord and said dashboard displays said real time training data and/or interpretive training data, which is based upon said real time training data, said dashboard having one or more display sections which correspond to a respective said pull cord and include graphical displays of said real time training data and said interpretive training data indicating whether physical performance and said real time training data is providing improvements relating to power, strength, endurance, hypertrophy or combinations thereof, and said real time training data for said velocity for a said repetition being displayed by a velocity graphical display, and said interpretive training data for said power being displayed on said graphical user interface as an indicator in combination with a power graphical display showing a plurality of exercise phases comprising at least an aerobic phase, a strength phase and a hypertrophy phase wherein said user is capable of adjusting their physical performance in real time to move said indicator to a desired one of said exercise phases.

9. The exercise system according to claim 8, wherein said one or more display sections comprise a first display section and a second display section, and said pull cords comprise a first pull cord and a second pull cord manually operable by left and right appendages of the user, and wherein said first and second display sections correspond respectively to said first and second pull cords.

10. The exercise system according to claim 9, wherein said plurality of exercise phases further comprise a strength hypertrophy phase wherein said user is capable of adjusting their physical performance in real time to move said indicator to said desired one of said exercise phases.

11. The exercise system according to claim 8, wherein said real time training data comprises power data and velocity data corresponding to said power and velocity performed during said repetition, wherein said power data and said velocity data are processed to generate said interpretive training data for said exercise phases.

12. The exercise system according to claim 8, wherein said velocity graphical display, said indicator and said power graphical display are provided for each of the first and second pull cords in a respective one of the first and second display sections to independently represent performance of the appendage displacing respective said first and second pull cords to allow independent variation of the exercise performed by each of the appendages and feedback in real time as the exercise is performed.

13. The exercise system according to claim 8, wherein said real time data further comprises a user heart rate displayed on said graphical user interface.

14. The exercise system according to claim 8, wherein said real time data displayed on said graphical user interface further comprises said power and said velocity of said pull cord movement during each said repetition repeated during said exercise and a heart rate of said user simultaneously during each said repetition such that the user is capable of monitoring their actual performance and adjusting their workout in real time to achieve their desired goal.

15. A software application on a computing device configured for use with an exercise device, wherein said exercise device comprises one or more resistance modules wherein each resistance module of said one or more resistance modules includes a coil storage spool configured to wrap and unwrap a respective pull cord emanating from each said resistance module, each said respective pull cord terminating at an outer end which is manually displaceable by a user during exercising, each said resistance unit at least generating resistance to extension of said respective pull cord, and said resistance unit further collecting real time training data in real time relating to physical movement of said respective pull cord wherein said training data indicates performance characteristics of the user during said exercises, said exercises comprising at least one repetition of a selected exercise wherein said repetition is performed at a variable velocity and power controlled by the user wherein said velocity and power result in performance impacts on aerobics, endurance, strength, hypertrophy or combinations thereof, said computing device being configured to receive said real time training data during said exercises and further comprising a graphical user interface, said software application being operated on said computing device and displaying a performance dashboard on said graphical user interface thereof, wherein said computing device receives said real time training data generated by physical movement of said respective pull cord and said dashboard displays said real time training data and/or interpretive training data, which is based upon said real time training data, said dashboard having one or more display sections which correspond to a respective said pull cord and include graphical displays of said real time training data and said interpretive training data indicating whether physical performance and said real time training data is providing improvements relating to power, strength, endurance, hypertrophy or combinations thereof, and said real time training data for said velocity for a said repetition being displayed by a velocity graphical display, and said interpretive training data for said power being displayed on said graphical user interface as an indicator in combination with a power graphical display showing a plurality of exercise phases comprising at least an aerobic phase, a strength phase and a hypertrophy phase wherein said user is capable of adjusting their physical performance in real time to move said indicator to a desired one of said exercise phases.

16. The exercise system according to claim 15, wherein said one or more display sections comprise a first display section and a second display section, and said pull cords comprise a first pull cord and a second pull cord manually operable by left and right appendages of the user, and wherein said first and second display sections correspond respectively to said first and second pull cords.

17. The exercise system according to claim 15, wherein said plurality of exercise phases further comprise a strength hypertrophy phase wherein said user is capable of adjusting their physical performance in real time to move said indicator to said desired one of said exercise phases.

18. The exercise system according to claim 15, wherein said real time training data comprises power data and velocity data corresponding to said power and velocity performed during said repetition, wherein said power data and said velocity data are processed to generate said interpretive training data for said exercise phases.

19. The exercise system according to claim 15, wherein said velocity graphical display, said indicator and said power graphical display are provided for each of the first and second pull cords in a respective one of the first and second display sections to independently represent performance of the appendage displacing respective said first and second pull cords to allow independent variation of the exercise performed by each of the appendages and feedback in real time as the exercise is performed.

20. The exercise system according to claim 15, wherein said real time data further comprises a user heart rate displayed on said graphical user interface.

* * * * *